US006778792B1

(12) United States Patent
Martin

(10) Patent No.: US 6,778,792 B1
(45) Date of Patent: Aug. 17, 2004

(54) LOW PRESSURE AIR DUCT SEAL ASSEMBLY

(75) Inventor: Scott A. Martin, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/368,222

(22) Filed: Feb. 18, 2003

(51) Int. Cl.[7] ..... G03G 21/20
(52) U.S. Cl. ..... 399/92; 285/918
(58) Field of Search ..... 399/91–93; 361/831; 285/918, 276, 321; 454/184, 186, 49, 56, 290; 174/16.1

(56) References Cited

U.S. PATENT DOCUMENTS 4,666,282 A 5/1987 Rowe
4,773,197 A * 9/1988 Sullivan ..... 454/290
5,424,806 A 6/1995 Siegel
6,082,783 A * 7/2000 Kawasaki et al. ..... 285/321

* cited by examiner

*Primary Examiner*—William J. Royer
(74) *Attorney, Agent, or Firm*—Fay, Sharpe, Fagan Minnich & McKee, LLP

(57) ABSTRACT

A low pressure air duct seal assembly for an electrophotographic reproduction machine is disclosed, which has a pair of air duct pieces. One of the air duct pieces has an end portion, an outer surface, and a circumferential groove formed on the outer surface and disposed adjacent the end portion. An O-ring is disposed in the groove, and heat shrink tubing is disposed over a portion of the outer surface of the air duct piece and covering the O-ring. The other air duct piece has an end portion and a coupling disposed adjacent the end portion for receiving the end portion of the first air duct piece.

20 Claims, 2 Drawing Sheets

LOW PRESSURE AIR DUCT SEAL ASSEMBLY

BACKGROUND

This invention relates generally to electrophotographic reproduction machines, and more particularly, concerns an air duct seal assembly suitable for low pressure air ducts that are intended to be disconnected and reconnected, such as those found in printers and copiers.

Generally, in the process of electrophotographic reproduction an image of an original document to be copied or printed is placed onto the surface of a photoconductive member (or photoreceptor) either by illuminating the original document, which is projected upon the photoconductive member to produce a latent electrostatic image corresponding to the original document, or by placing the image onto the photoreceptor by electronic means. The latent electrostatic image is developed by means of fusible particles to produce a visible toner image that is transferred to a substrate, such as a piece of paper. The unfused toner image may be fixed to the substrate by means of heat and pressure by pressing the substrate through the nip of a pair of rollers, at least one of which is heated.

It is essential to the maintenance of copy quality and reliability that the machine environment be controlled. For example, ozone emission is tightly regulated for health and safety reasons, and dirt and toner dust has been shown to be one of the most significant contributors to machine failures and service actions. In addition, paper debris, such as fibers and dust fillers, contribute significantly to failures of machines. For instance, debris in the paper path fouls sensors, solenoids, and frictional materials; fillers foul fuser oils; and fibers ruin photoreceptor belts. Thus, low pressure air systems (i.e., less that one inch of water pressure) are often used in electrophotographic reproduction machines as a means of controlling the machine environment. In smaller machines a single blower will generally purge and cool the entire machine with ambient air. In larger machines, several blowers are generally required to serve as subsystems by the addition or removal of air. In these machines, duct work is often required to direct the air since it is not always practical to place an air handling device directly at the point of application.

Further, with the advent of high speed reproduction machines, wherein copiers or printers can produce at a rate in excess of several thousand copies per hour, the need for sheet handling systems to, for example, feed paper or other media through various process stations in a rapid succession in a reliable and dependable manner in order to utilize the full capabilities of the reproduction machine is apparent. These sheet handling systems must operate flawlessly to virtually eliminate risk of damaging the recording sheets and generate minimum machine shutdowns due to misfeeds or multifeeds. It is in the initial separation of the individual sheets from the media stack where the greatest number of problems occur which, in some cases, can be due to curl up curl and down curl in sheets which generally occur randomly in the document stack. Accordingly, these machines can require a separate low pressure air system featuring duct work to fluff the paper.

An important concern in such low pressure air systems is maintaining an air tight seal in the duct work. In some instances, it can be necessary to have portions of the air duct that repeatedly disconnect and reconnect, such as when a drawer (or door) is opened and closed. That is, an air duct piece may be mounted somewhere on the machine body and form a connection with another air duct piece mounted on a drawer when the drawer is closed to duct air through the machine. In this situation, it is necessary to be able to maintain a tight seal each time the two air duct pieces are disconnected and subsequently reconnected by opening and closing the drawer.

It is known to provide mounting flanges extending radially outwardly at the ends of the two air duct pieces that are to be connected. One of the flanges can have a piece of compressible, open-ell foam attached to its planar end face for engagement with the planar end face of the other flange. Therefore, when the drawer is closed and the two air duct pieces are reconnected, the foam can provide a seal. However, this connection is not without problems. For instance, the foam used in this type of connection has a tendency to permanently deform and not seal properly after repeated use. Also, the use of flanges on the connecting ends of the air duct portions can give the seal a high profile, which is not desirable in tight spaces where space is a prime consideration. Furthermore, this type of connection has low penetration latitude, providing a short sealing surface in the plane perpendicular to the axis of the duct. Simply increasing the length of foam in an attempt to increase the penetration latitude will not work because the foam becomes increasingly unstable due to stack-up tolerances as its length is increased.

It is also known to use an O-ring to seal smaller air ducts, i.e., those less than 5 millimeters in diameter. However, an O-ring alone will not work when the air duct has a diameter greater than 5 millimeters. This is because of the high friction caused by the increased diameter of the O-ring.

Therefore, although the above-described seals have been successful to some extent, an improvement is still needed.

SUMMARY

In accordance with one aspect of the present invention, an improved low pressure air duct seal assembly for use with air ducts that are intended to be disconnected and reconnected is disclosed, which is space efficient, creates an air tight, stable seal, has high penetration latitude, and provides for low friction reconnection. This improved air duct seal assembly features the use of a thin layer of heat shrink tubing over a compressible O-ring, which is disposed in a groove around the outside of one of the air duct pieces to be connected, thus creating a low friction sealing surface. This duct piece is then inserted into a coupling with a corresponding sealing surface and connects with the receiving air duct piece. The purpose of the compressible O-ring is to make the seal compliant and to allow for variations in part diameter. The heat shrink tubing is used to hold in the O-ring and to reduce the insertion force by reducing the friction between it and the sealing surface on the receiving duct piece.

Still further advantages and benefits of the present invention will become apparent to those of ordinary skill in the art upon reading and understanding the following detailed description of the preferred embodiments.

The invention may take form in various components and arrangements of components, and in various steps and arrangements of steps. The drawings are only for purposes of illustrating preferred embodiments and are not to be construed as limiting the invention.

DETAILED DESCRIPTION OF THE INVENTION

The invention will now be described by reference to a preferred embodiment of a low pressure air duct seal assembly for use in a wide variety of printing and copying systems. However, it should be understood that the air duct seal assembly of the present invention could be used with other machines having low pressure air handling systems, such as HVAC systems and automobiles.

Figure 1:
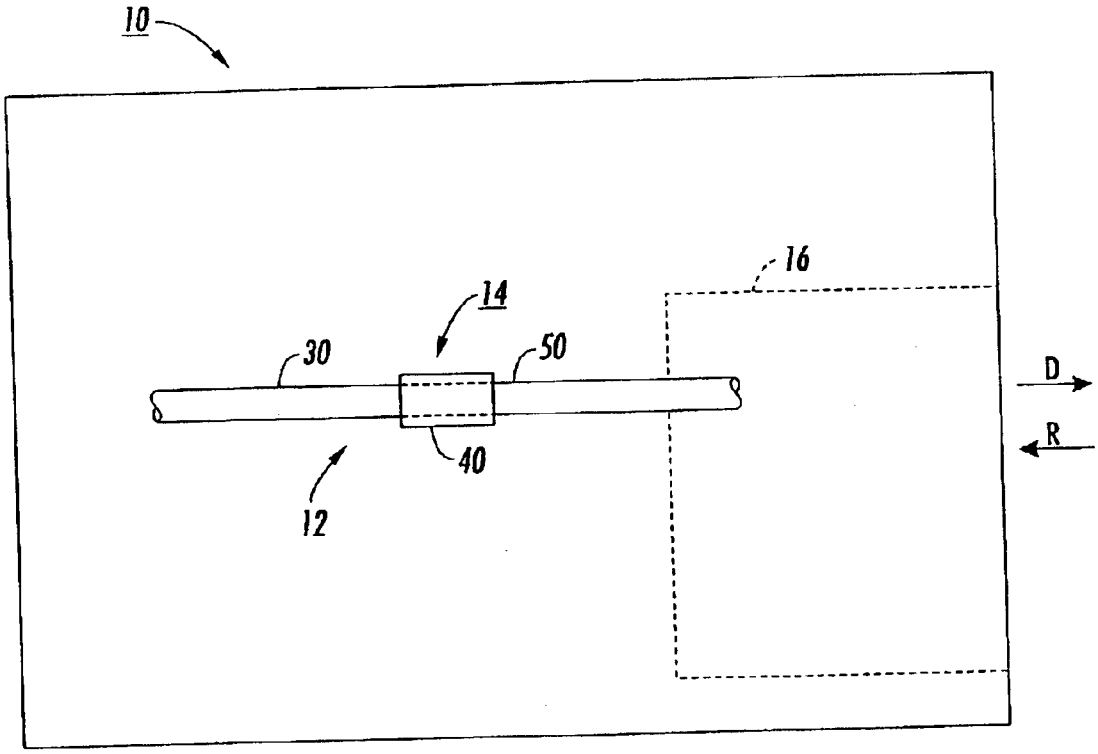
FIG. 1 illustrates a simplified block diagram of an electrophotographic reproduction machine with a low pressure air duct and seal assembly according to the present invention.

FIG. 1 illustrates an electrophotographic reproduction machine 10 having a low pressure air duct 12 with a seal assembly 14 for sealing a pair of air duct pieces 30, 50 when the two pieces 30, 50 are joined together over repeated disconnection-reconnection cycles. The first air duct piece 30 is generally mounted at a mounting end to a stationary part of machine 10 such as a wall. The second air duct piece is generally mounted to a movable component of the machine 10, such as a drawer 16. Thus, when the drawer 16 is opened, the second air duct piece 50 moves in the disconnection direction D. Conversely, when the drawer 16 is closed, the second air duct piece 50 moves in the reconnection direction R.

Figure 2:
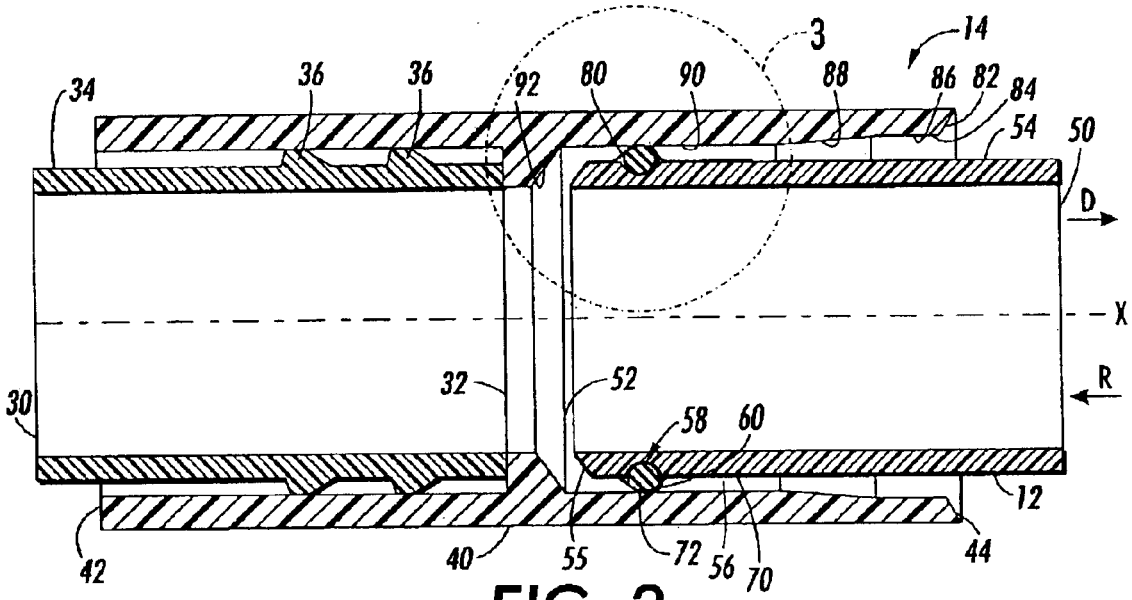
FIG. 2 illustrates a cross sectional view of an air duct seal assembly having the features of the present invention.
Figure 3:
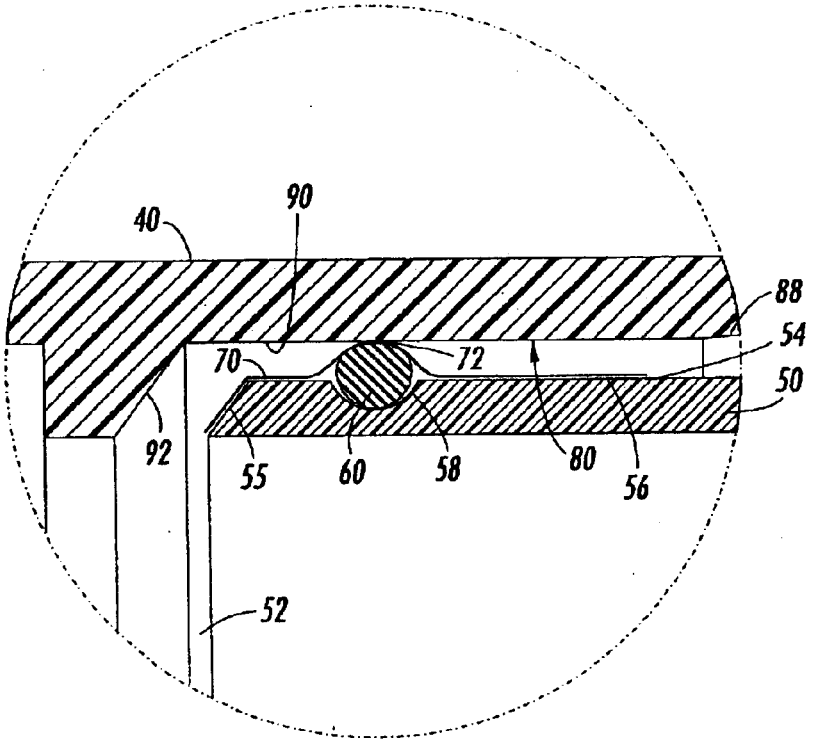
FIG. 3 illustrates an enlarged cross sectional view of a portion of the air duct seal assembly.

Referring now to FIGS. 2 and 3, there is illustrated a preferred embodiment of the low pressure air duct seal assembly 14. In this design, the seal assembly 14 comprises the first air duct piece 30, a coupling 40, the second air duct piece 50, an O-ring 60, and heat shrink tubing 70.

In the preferred embodiment, the first air duct piece 30 has an end portion 32 that is adapted to connect with the second air duct piece 50. The end portion 32 has an axis X and an outer surface 34. The coupling 40 is disposed adjacent the end portion 32 of the first air duct piece 30. In the preferred embodiment, the coupling 40 is a separate component and has a mounting end portion 42 that is secured to the end portion 32 by an adhesive, although it can be secured in any other suitable manner. The outer surface 34 of the end portion 32 can optionally include a plurality of circumferential ribs 36 to improve the adhesive bond between the first air duct piece 30 and the coupling 40. Alternatively, the coupling 40 can also be formed integrally with the end portion 32 of the first air duct piece 30.

The coupling 40 is coaxial with the end portion 32 of the first air duct piece 30 and has a receiving end portion 44 disposed axially opposite of the mounting end portion 42. The receiving end portion 44 has an interior sealing surface 80 that is adapted to receive the second air duct piece 50. As shown in FIGS. 2 and 3, the sealing surface 80 can be tapered at various points along the surface moving axially from the receiving end portion 44 to the mounting end portion 42. In the preferred embodiment, the sealing surface 80 has a first section 82 that can be tapered radially inwardly to allow for easier insertion of the second duct air duct piece 50, a second section 84 that can be more gradually tapered radially inwardly to allow for further insertion of the second air duct piece 50, a third section 86 that is generally flat and parallel to the axis X, a fourth section 88 that is tapered radially inwardly, a fifth section 90 that is generally flat and parallel to the axis X, and a sixth section 92 that is tapered radially inwardly to connect with the coupling 40. However, it is not necessary that the first section 82 and the sixth section 92 be tapered. Thus, the first section 82 may be flat and parallel to the axis X, and the sixth section 92 may have a planar end face that is perpendicular to the axis X. Further, it is not crucial to the invention that the sealing surface 80 be composed of six sections as shown in the figures. Rather, alternative configurations for the sealing surface 80 may be contemplated in accordance with the present invention so long as an air tight seal is formed when the two air duct pieces 30, 50 are connected.

The second air duct piece 50 has an end portion 52. The end portion 52 is coaxial with the end portion 32 of the first air duct piece 30 and the coupling 40, and it is adapted to be inserted into the coupling 40 to form a connection with the first air duct piece 30 for ducting air. The second air duct piece 50 has an outer surface 54. As shown in FIGS. 2 and 3, the outer surface 54 can have a first section 55 that is tapered radially inwardly and corresponds to the sixth section 92 of the coupling 40 and a second section 56 that is generally flat and parallel to the axis X. The end portion 52 of the second air duct piece 50 also has a circumferential groove 58 around the outer surface 54. The groove 58 is adapted to hold a compressible O-ring 60, which can be formed of any suitable known material. The O-ring 60, in turn, is held firmly in place by a thin layer of heat shrink tubing 70. The heat shrink tubing 70 can be formed of any suitable known compound, including, but not limited to, polytetrafluoroethylene (PFTE). Generally, the heat shrink tubing 70 is expanded mechanically to slide over the end portion 52 to cover a portion of the outer surface 54 and the O-ring 60. The heat shrink tubing 70 is then subjected to elevated temperatures to shrink to a tight fit that will not fall off of the end portion 52 during repeated disconnection-reconnection cycles. The portion of the heat shrink tubing 70 that covers the O-ring 60 thus forms an exterior sealing surface 72.

As noted earlier, the second air duct piece 50 can be mounted to a movable component in the machine 10, such as the drawer 16. Thus, when the drawer 16 is closed, the end portion 52 slides easily into the coupling 40 due to the low friction of the heat shrinkable tubing 70 and connects with the end portion 32 of the first air duct piece 20. Alternatively, the first air duct piece 30 can be movable and the second air duct piece 50 can be stationary.

The addition of the compressible O-ring 60 helps to form an airtight seal, thus preventing a loss of air from the low pressure air duct 12. The seal assembly 14 will remain air tight throughout repeated disconnection and reconnection of the pieces 30, 50. The addition of the O-ring 60 and the heat shrink tubing 70 allows for the combined advantages of reducing the insertion force necessary to make the connection, while providing good sealing after repeatedly disconnecting and reconnecting the air duct pieces 30, 50. The use of the O-ring 60 makes the seal compliant and allows for variations in part diameter. The heat shrink tubing 70 holds in the O-ring 60 and reduces the insertion force by reducing the friction between the coupling 40 and the second air duct piece 50.

The air duct seal assembly 14 has a low profile and provides all of the compliance and sealing surface latitudes of a standard O-ring seal, but requiring a lower insertion force and having long term reliability. The low pressure air duct seal assembly 14 is especially useful when the air duct end portions 32 and 52 are greater than 5 millimeters in diameter each.

While particular embodiments have been described, alternatives, modifications, variations, improvements, and substantial equivalents that are or may be presently unforeseen may arise to applicant or others skilled in the art. Accordingly, the appended claims as filed and as they may be amended are intended to embrace all such alternatives, modifications, variations, improvements, and substantial equivalents.

What is claimed is:

1. A low pressure air duct seal assembly for an electrophotographic reproduction machine, including:

a first air duct piece having an end portion, an outer surface, and a circumferential groove formed on said outer surface and disposed adjacent said end portion;

a second air duct piece having an end portion and a coupling disposed adjacent said end portion for receiving said end portion of said first air duct piece;

an O-ring disposed in said groove; and heat shrink tubing disposed over a portion of said outer surface of said first air duct piece and covering said O-ring.

2. The air duct seal assembly of claim 1, wherein one of said first and second air duct pieces is stationary and the other of said first and second air duct pieces is movable for being disconnected from said stationary air duct piece and reconnected with said stationary air duct piece.

3. The air duct seal assembly of claim 2, wherein said coupling is mounted to said end portion of said second air duct piece.

4. The air duct seal assembly of claim 3, wherein said coupling is mounted to said end portion of said second air duct piece with an adhesive.

5. The air duct seal assembly of claim 4, wherein said second air duct piece has an outer surface with a plurality of circumferential ribs for mounting said coupling to said end portion of said second air duct piece.

6. The air duct seal assembly of claim 2, wherein said coupling is formed integrally with said end portion of said second air duct piece.

7. The air duct seal assembly of claim 1, wherein said end portion of said first air duct piece and said end portion of said second air duct piece both have a diameter that is greater than 5 millimeters.

8. The air duct seal assembly of claim 1, wherein said heat shrink tubing is polytetrafluoroethylene.

9. The air duct seal assembly of claim 1, wherein said coupling has an inner surface having a plurality of axially spaced sections, at least two of said sections being tapered radially inwardly for receiving said second air duct piece and creating an air tight seal.

10. The air duct seal assembly of claim 1, wherein said coupling has an inner surface having six axially spaced sections, at least four of said sections being tapered radially inwardly for receiving said second air duct piece and creating an air tight seal.

11. A low pressure air duct system, including:

a first air duct piece having an end portion, an outer surface, and a circumferential groove formed on said outer surface and disposed adjacent said end portion;

a second air duct piece having an end portion and a coupling disposed adjacent said end portion for receiving said end portion of said first air duct piece;

an O-ring disposed in said groove; and heat shrink tubing disposed over a portion of said outer surface of said first air duct piece and covering said O-ring.

12. The air duct system of claim 11, wherein one of said first and second air duct pieces is stationary and the other of said first and second air duct pieces is movable for being disconnected from said stationary air duct piece and reconnected with said stationary air duct piece.

13. The air duct system of claim 12, wherein said coupling is mounted to said end portion of said second air duct piece.

14. The air duct system of claim 13, wherein said coupling is mounted to said end portion of said second air duct piece with an adhesive.

15. The air duct system of claim 14, wherein said end portion of said second air duct piece has an outer surface with a plurality of circumferential ribs for mounting said coupling to said end portion of said second air duct piece.

16. The air duct system of claim 12, wherein said coupling is formed integrally with said end portion of said second air duct piece.

17. The air duct system of claim 11, wherein said end portion of said first air duct piece and said end portion of said second air duct piece both have a diameter that is greater than 5 millimeters.

18. The air duct system of claim 11, wherein said heat shrink tubing is polytetrafluoroethylene.

19. The air duct system of claim 11, wherein said coupling has an inner surface having a plurality of axially spaced sections, at least two of said sections being tapered radially inwardly for receiving said second air duct piece and creating an air tight seal.

20. The air duct seal assembly of claim 11, wherein said coupling has an inner surface having six axially spaced sections, at least four of said sections being tapered radially inwardly for receiving said second air duct piece and creating an air tight seal.

* * * * *